US008448714B2

(12) United States Patent
Park et al.

(10) Patent No.: US 8,448,714 B2
(45) Date of Patent: May 28, 2013

(54) FUSE TYPE SPRINKLER

(75) Inventors: Kwang Jin Park, Seoul (KR); Jae Kil Shim, Seoul (KR); Sung Ki An, Bucheon-si (KR)

(73) Assignee: Asia Union Co., Ltd. (KR)

( * ) Notice: Subject to any disclaimer, the term of this patent is extended or adjusted under 35 U.S.C. 154(b) by 492 days.

(21) Appl. No.: 12/774,237

(22) Filed: May 5, 2010

(65) Prior Publication Data

US 2011/0272168 A1 Nov. 10, 2011

(51) Int. Cl.
*A62C 37/08* (2006.01)

(52) U.S. Cl.
USPC ..... 169/37; 169/38; 169/39; 239/DIG. 4

(58) Field of Classification Search
CPC ..... A62C 35/00
USPC ..... 169/16, 37, 38, 39; 239/498, 504, 239/518, 569, DIG. 4
See application file for complete search history.

(56) References Cited

U.S. PATENT DOCUMENTS

| | | | | | |
|---|---|---|---|---|---|
| RE29,155 | E | * | 3/1977 | Mears et al. | 239/569 |
| 4,121,665 | A | * | 10/1978 | Woycheese | 239/DIG. 4 |
| 4,766,961 | A | * | 8/1988 | Macie | 169/38 |
| 5,094,298 | A | * | 3/1992 | Polan | 169/37 |
| 6,123,153 | A | * | 9/2000 | Finnegan | 169/37 |
| 6,439,315 | B2 | * | 8/2002 | Onuki | 169/37 |

FOREIGN PATENT DOCUMENTS

KR 20-0438885 3/2008

* cited by examiner

*Primary Examiner* — Steven J Ganey
(74) *Attorney, Agent, or Firm* — Cantor Colburn LLP

(57) ABSTRACT

A fuse type sprinkler has a body which is fastened to a drain pipe for spraying water through a drain formed inside, a valve of which an upper end is inserted into the drain of the body and to which a sealing unit is mounted along an upper end circumference to press and seal an inner surface of the drain, a frame which is fastened to the body to surround the valve and is provided with a hook on a lower end inner peripheral surface, a heat sensing unit which supports a lower end of the valve to allow an upper end of the valve to be inserted into the drain while being hooked by the hook of the frame, and is provided with a fuse which is separated from the frame to fall off when the fuse is fused by heat, and a deflector which is positioned inside the frame and falls off and is hung on the hook when the heat sensing unit is separated to distribute water sprayed through the drain.

9 Claims, 11 Drawing Sheets

FUSE TYPE SPRINKLER

BACKGROUND

1. Field

This disclosure relates to a fuse type sprinkler, and more particularly, to a fuse type sprinkler which can solve a problem of a fuse being cooled by leaking water during fire and being not completely fused so as not to operate the sprinkler.

2. Description of the Related Art

A fuse type sprinkler is a sprinkler configured so that a fuse is embedded into a head of the sprinkler and the fuse is fused by heat during fire to spray water through a drain pipe installed in the ceiling.

Such a fuse type sprinkler has to spray water as the fuse is fused at the beginning of fire. However, the existing fuse type sprinkler is problematic in that when water leaks as the fuse is partly fused by heat, the fuse is cooled by the leaking water and cannot be completely fused so as not to operate the sprinkler.

The sprinkler is a fire-fighting equipment configured to control fire early. When the fire is not controlled early, extinguishing of the fire becomes difficult.

SUMMARY

This disclosure provides a fuse type sprinkler configured to prevent a malfunction of the sprinkler due to leaking water during fire.

In one aspect, there is provided a fuse type sprinkler including: a body which is fastened to a drain pipe for spraying water through a drain formed inside; a valve of which an upper end is inserted into the drain of the body and to which a sealing unit is mounted along an upper end circumference to press and seal an inner surface of the drain; a frame which is fastened to the body to surround the valve and is provided with a hook on a lower end inner peripheral surface; a heat sensing unit which supports a lower end of the valve to allow an upper end of the valve to be inserted into the drain while being hooked by the hook of the frame, and is provided with a fuse which is separated from the frame to fall off when the fuse is fused by heat; and a deflector which is positioned inside the frame and falls off and is hung on the hook when the heat sensing unit is separated to distribute water sprayed through the drain.

In an embodiment, an inner side surface of the drain is coated with Teflon.

In an embodiment, the sealing unit is an O-ring, and the upper end of the valve is provided with an O-ring mounting groove to which the O-ring is mounted, In an embodiment, a lower end inner side of the drain is provided with a stepped portion, and the upper end of the valve is inserted into the stepped portion so that the O-ring comes in contact with a side surface of the stepped portion.

In an embodiment, the sealing unit is a gasket mounted to the upper end of the valve, and the gasket comes in contact with a stepped portion formed on a lower end inside of the drain to seal the drain.

In an embodiment, a washer is fixed on the gasket at the upper end of the valve, and the washer is positioned at an upper portion of the stepped portion while coming in contact with the inner surface of the drain.

In an embodiment, the heat sensing unit includes: a pinching plate; a ball balancer positioned under the pinching plate; a heat plate positioned under the ball balancer; balls positioned at a boundary of a space between the pinching plate and the ball balancer to be positioned on an upper portion of the hook; a fixing bolt penetrating centers of the pinching plate, the ball balancer, and the heat plate; a fuse piston fastened to a lower end of the fixing bolt; and a fuse which is set on the fuse piston to support the heat plate.

In an embodiment, a boundary of the pinching plate is provided with grooves formed toward the center to correspond to the balls, and the groove is provided with a gradient so that the balls roll toward the center of the pinching plate.

In an embodiment, the ball comes in contact with the hook, the pinching plate, and the ball balancer, and a boundary of a ball balancer is provided with a gradient.

In an embodiment, a guide for surrounding the deflector is positioned inside the frame, and the guide guides a movement direction of the deflector when the heat sensing unit falls off the frame.

In an embodiment, the guide has a diameter smaller than an inner diameter of the hook formed in the frame, and a boundary of the guide is provided with guide pieces bent upwardly to surround a side surface of the deflector.

In an embodiment, the heat plates include: a first heat plate having a cylinder shape protruding upward at the center; and two second heat plates stacked on a circumference of the cylinder. The second heat plate positioned above from among the two second heat plates is forcibly inserted into the cylinder to be fixed.

In an embodiment, a spring fixing bolt is fastened to the lower end of the valve, a coil spring is positioned between a head top surface of the spring fixing bolt and the deflector, and the coil spring is pressed as the upper end of the valve is pushed by the heat sensing unit and inserted into the drain when the frame mounted with the heat sensing unit is fastened to the body.

In an embodiment, a pocket ring which is the sealing unit is provided with a hollow through which the upper end of the valve penetrates, and an outer peripheral surface of the pocket ring is applied with a lubricant to seal between the outer peripheral surface of the pocket ring and an inner side surface of the drain.

In an embodiment, an annular groove is formed along the outer peripheral surface of the pocket ring.

In an embodiment, a gasket is mounted to the upper end of the valve below the pocket ring, and the gasket comes in contact with a stepped portion formed on a lower end inner side of the drain to seal the drain.

As described above, the fuse type sprinkler is configured so as not to leak water until the heat sensing unit is completely separated. Therefore, there is an advantage in that a malfunction of the sprinkler due to the fuse cooled by water leaking when a part of the fuse is fused.

In addition, in the fuse type sprinkler, the pinching plate and the ball balancer are provided with gradients to guide the separation of the balls so as to enable the balls to properly fall when the heat sensing unit falls off. Therefore, the separation of the heat sensing unit caused when the ball does not move can be prevented in advance.

In addition, in the fuse type sprinkler, the heat plates are assembled by forced insertion, so that the heat plates can be conveniently mounted to the heat sensing unit.

In addition, in the case of the sprinkler mounted with the gasket, the valve mounted with the gasket is supported by the heat sensing unit, so that an excessive force is not exerted on the gasket, thereby preventing plastic deformation of the gasket.

BRIEF DESCRIPTION OF THE DRAWINGS

The above and other aspects, features and advantages of the disclosed exemplary embodiments will be more apparent from the following detailed description taken in conjunction with the accompanying drawings in which.

DETAILED DESCRIPTION

Figure 1:
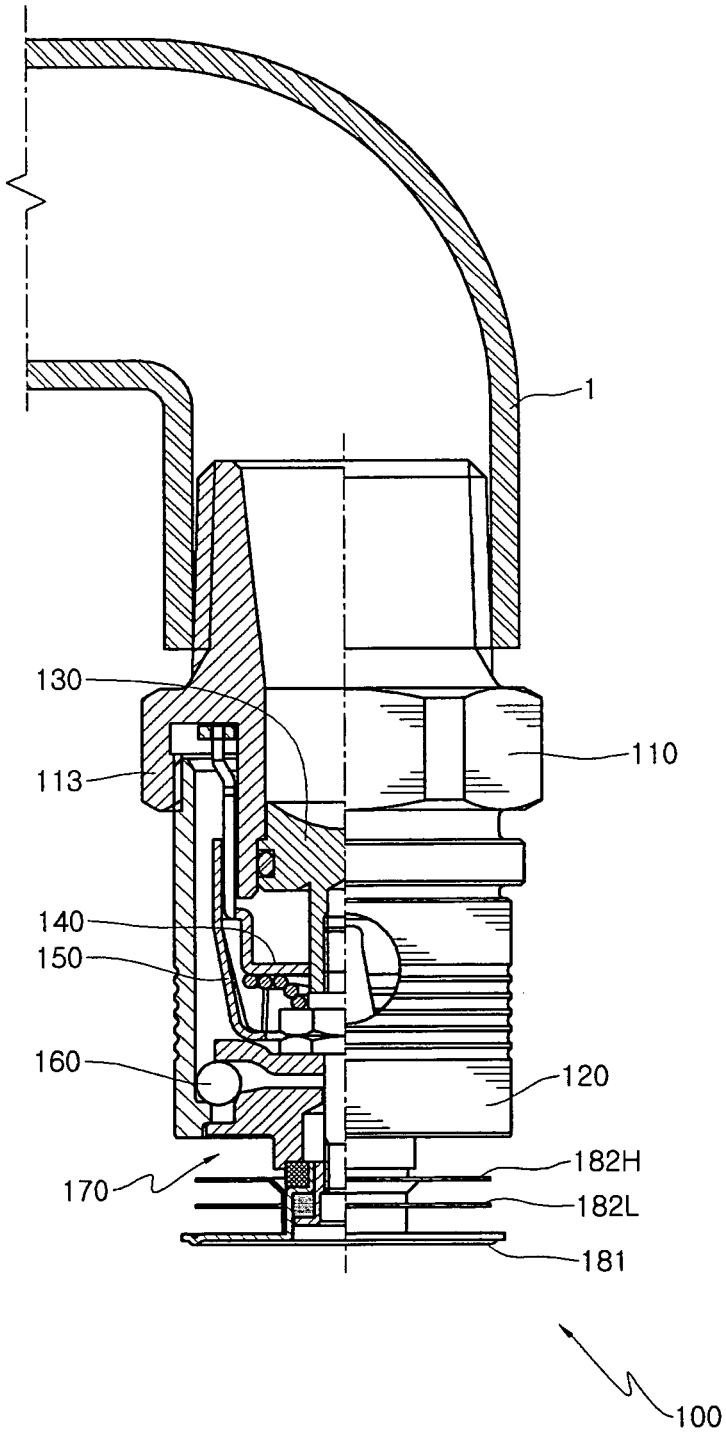
FIG. 1 is a partial sectional view illustrating a fuse type sprinkler according to an embodiment.

Exemplary embodiments now will be described more fully hereinafter with reference to the accompanying drawings, in which exemplary embodiments are shown. This disclosure may, however, be embodied in many different forms and should not be construed as limited to the exemplary embodiments set forth therein. Rather, these exemplary embodiments are provided so that this disclosure will be thorough and complete, and will fully convey the scope of this disclosure to those skilled in the art. In the description, details of well-known features and techniques may be omitted to avoid unnecessarily obscuring the presented embodiments.

The terminology used herein is for the purpose of describing particular embodiments only and is not intended to be limiting of this disclosure. As used herein, the singular forms "a", "an" and "the" are intended to include the plural forms as well, unless the context clearly indicates otherwise. Furthermore, the use of the terms a, an, etc. does not denote a limitation of quantity, but rather denotes the presence of at least one of the referenced item. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, like reference numerals in the drawings denote like elements. The shape, size and regions, and the like, of the drawing may be exaggerated for clarity.

Hereinafter, fuse type sprinklers according to exemplary embodiments will be described in detail with reference to the accompanying drawings.

Embodiment 1

Figure 2:
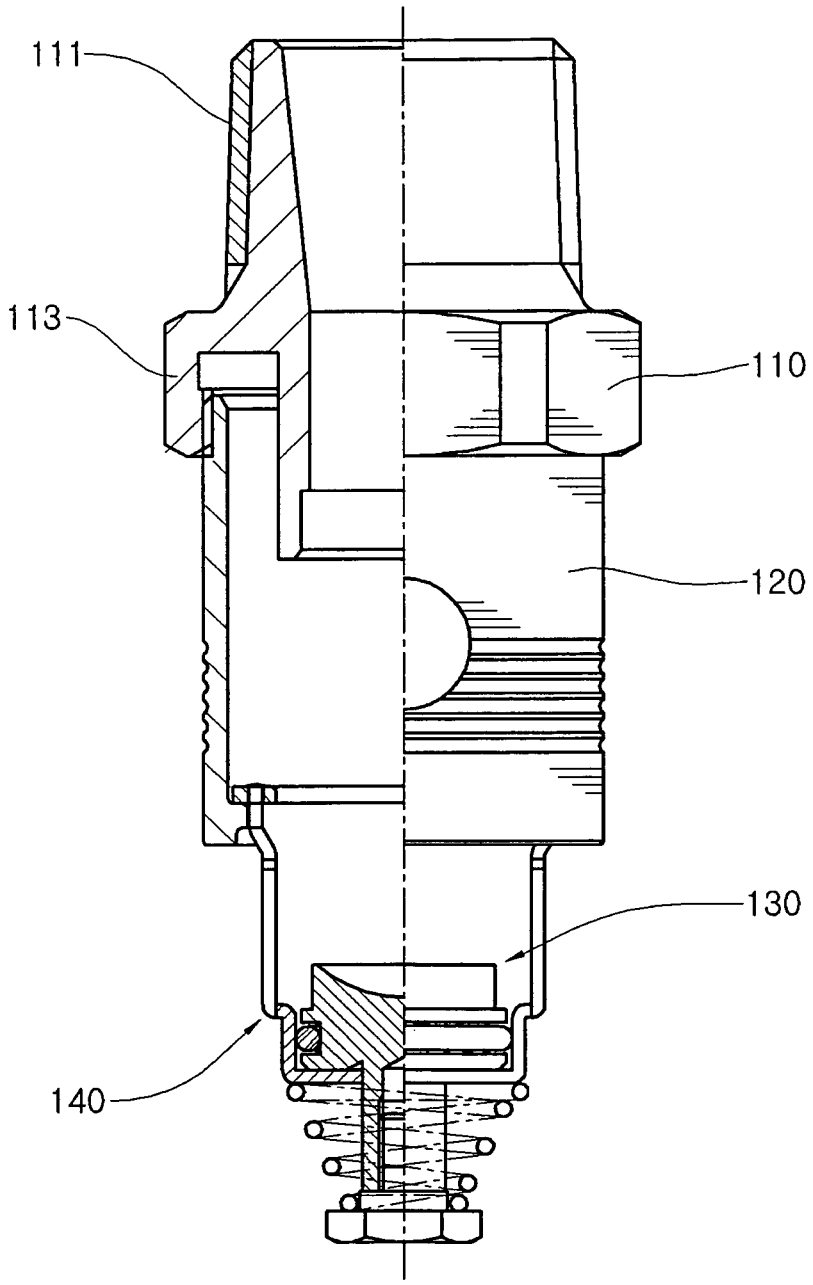
FIG. 2 is a partial sectional view illustrating a state where the fuse type sprinkler illustrated in FIG. 1 is operated.
Figure 3:
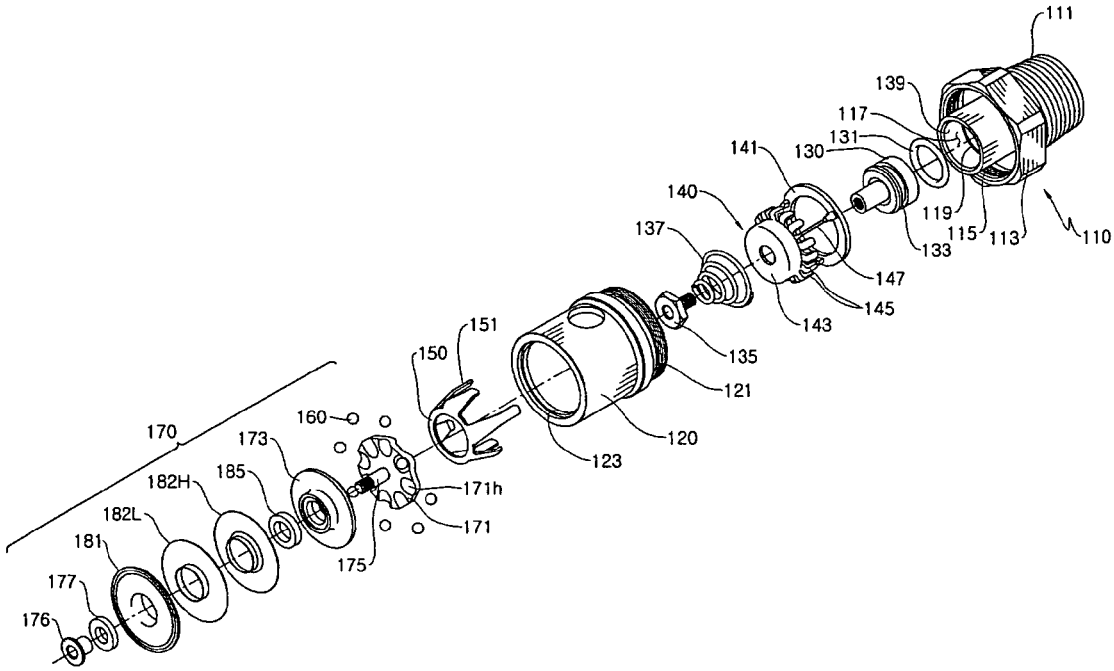
FIG. 3 is an exploded perspective view of the fuse type sprinkler illustrated in FIG. 1.
Figure 4:
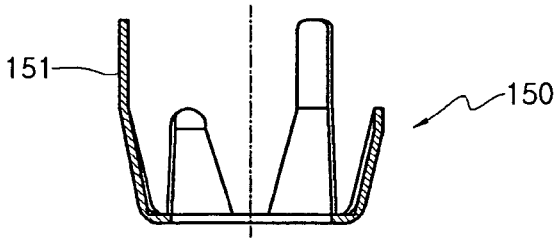
FIG. 4 is a bottom view illustrating a deflector of the fuse type sprinkler illustrated in FIG. 3.
Figure 5:
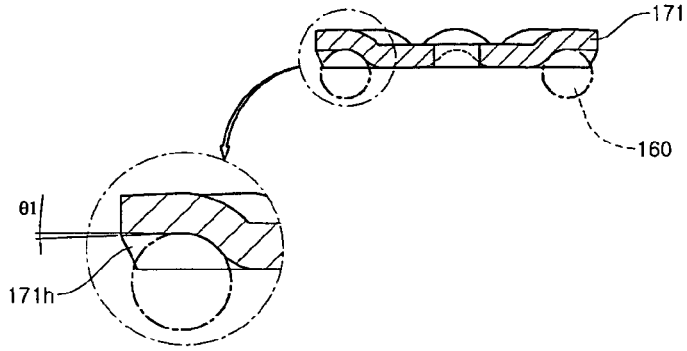
FIG. 5 is a detailed view illustrating a gradient provided in a groove of a pinching plate illustrated in FIG. 3.
Figure 6:
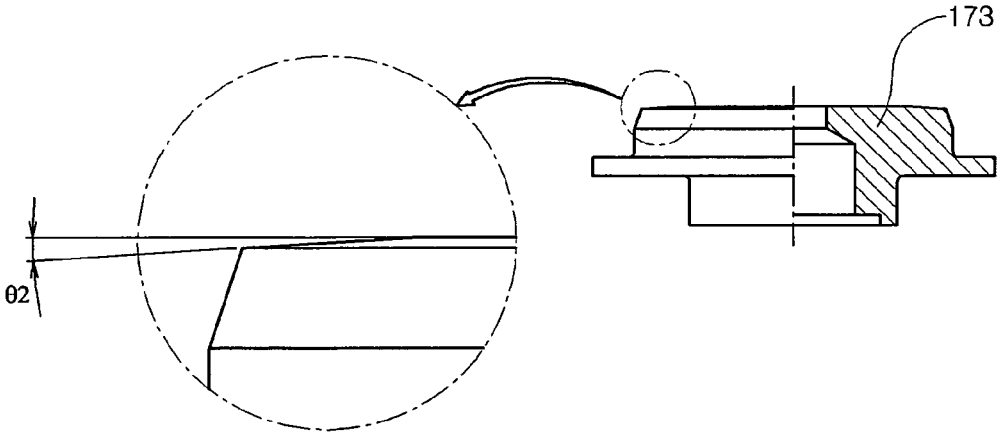
FIG. 6 is a partial sectional view illustrating a ball balancer illustrated in FIG. 3.
Figure 7:
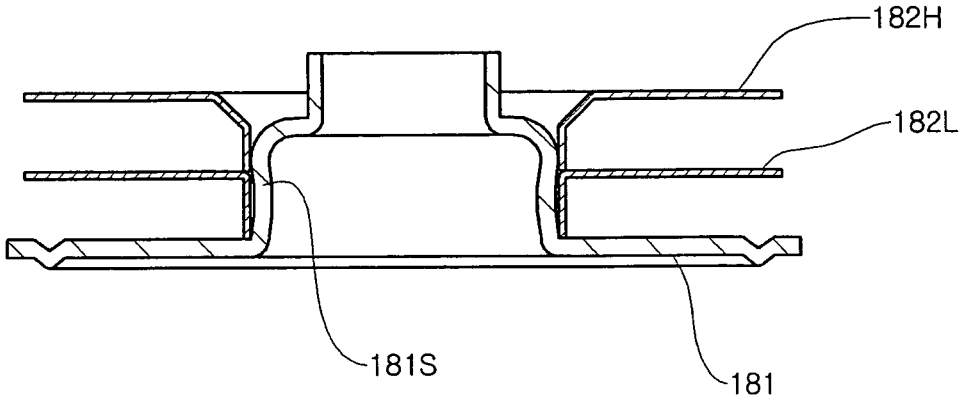
FIG. 7 is a sectional view illustrating an assembled state of heat plates illustrated in FIG. 3.
Figure 8:
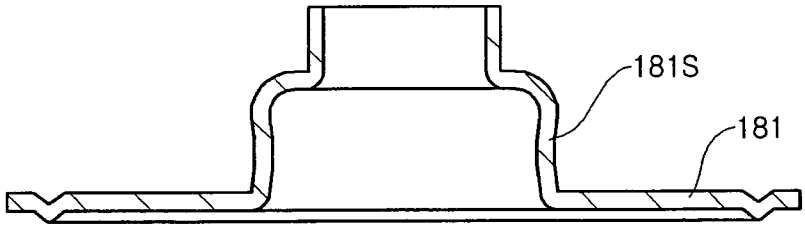
FIG. 8 is a sectional view illustrating a first heat plate illustrated in FIG. 7.

FIG. 1 is a partial sectional view illustrating a fuse type sprinkler according to Embodiment 1. FIG. 2 is a partial sectional view illustrating a state where the fuse type sprinkler illustrated in FIG. 1 is operated. FIG. 3 is an exploded perspective view of the fuse type sprinkler illustrated in FIG. 1. FIG. 4 is a bottom view illustrating a deflector of the fuse type sprinkler illustrated in FIG. 3. FIG. 5 is a detailed view illustrating a gradient provided in a groove of a pinching plate illustrated in FIG. 3. FIG. 6 is a partial sectional view illustrating a ball balancer illustrated in FIG. 3. FIG. 7 is a sectional view illustrating an assembled state of heat plates illustrated in FIG. 3. FIG. 8 is a sectional view illustrating a first heat plate illustrated in FIG. 7.

As illustrated in FIGS. 1 to 3, a fuse type sprinkler 100 includes a body 110 fastened to a drain pipe 1 installed in a ceiling, a frame 120 screwed to a lower end of the body 110, a valve 130 which is provided inside the frame 120 to seal a drain 117 formed at an inner lower end of the body 110, and heat sensing unit 170 which allows the fuse 177 mounted and embedded into the frame 120 to be fused by heat and to fall off the frame 120 so as to open the valve 130.

The fuse type sprinkler having the above-mentioned configuration will now be described in detail.

As illustrated in FIGS. 1 to 3, the body 110 has a cylindrical structure. A male screw 111 is formed on an upper outer peripheral surface of the body 110, and a socket 113 is formed at a longitudinal intermediate portion of the body 110. A female screw is formed on an inner peripheral surface of the socket 113.

The valve 130 is mounted to the drain 117 provided inside the body 110, and specifically, the valve 130 is inserted and fitted into the drain 117 of the body 110. A stepped portion 119 is formed on a lower inner peripheral surface of the drain 117, and the valve 130 is fitted to an inner side of the stepped portion 119. Therefore, when the valve 130 is fitted to the drain 117 of the body 110, the valve is slid toward the inside of the body 110 by a depth of the stepped portion 119. In order to allow the valve 130 to be separated from the body 110, the valve is slid out by the depth of the stepped portion 119. In this manner, the valve 130 is completely separated from the drain 117.

An O-ring 131 which is a sealing unit is mounted to the valve 130 at a position corresponding to the stepped portion 119. When the valve is fitted to the drain 117 of the body 110, the O-ring 131 presses an inner side surface of the stepped portion of the drain 117 while being pressed to seal the drain 117. An O-ring mounting groove 133 is provided on an upper end periphery of the valve 130 along the circumference to fix the O-ring 131. The inner side surface of the stepped portion 119 of the drain 117 is coated with Teflon 139 to allow the O-ring 131 to slide smoothly.

A spring fixing bolt 135 is mounted to a lower end of the valve 130. The spring fixing bolt 135 is positioned at a lower portion of the deflector 140 described later and fixes a conical coil spring 137 that surrounds a periphery of the spring fixing bolt 135. The conical coil spring 137 is positioned to come in contact with a head upper surface of the spring fixing bolt 135 and a bottom surface of the deflector 140. When the valve 130 is fitted to the drain 117, it is compressed. When the fuse 177 described later is fused, the heat sensing unit 170 falls off, and the conical coil spring 137 extends to separate the valve 130 out of the drain 117.

The deflector 140 includes an annular ring 141 positioned inside the socket 113 of the body 110, a guide portion 143 which is provided with water spray pieces 145 that are bent upward from a boundary of a disc along its circumference to spray in a radial direction water discharged from the drain 117 and is also provided with a hollow at the center through which the spring fixing bolt 135 penetrates, and a support portion 147 which connects the annular ring 141 to the guide portion 143.

The annular ring 141 of the deflector 140 having the above-mentioned configuration is positioned inside the socket 113, and the spring fixing bolt 135 is fastened and fixed to a lower end surface of the valve 130 while penetrating the conical coil spring 137 and the hollow of the guide portion 143. Therefore, when the spring fixing bolt 135 is pushed up, the annular ring 141 comes in contact with an interior of the socket 113, and the valve 130 is inserted toward the inside of the body 110 by the force transmitted from the spring fixing bolt 135. As the spring fixing bolt 135 is moved upward while the annular ring 141 of the deflector 140 is positioned inside the socket 113, the conical coil spring 137 is compressed between the head of the spring fixing bolt 135 and the deflector 140.

The frame 120 is screwed to the socket 113 of the body 110. The frame 120 has a cylindrical structure, wherein a male screw 111 is formed on an upper end outer peripheral surface so as to be screwed to the socket 113.

In addition, a guide 150 is mounted inside the frame 120. The guide 150 is configured so that guide pieces 151 which enclose an exterior of the support portion 147 of the guide portion 143 are bent upward and a hollow is formed at the center. The hollow of the guide 150 has a smaller diameter than a disc of the deflector 140 and has a greater diameter than the head of the spring fixing bolt 135.

The heat sensing unit 170 is positioned below the guide 150, and the heat sensing unit 170 is mounted to a lower end of the frame 120.

As illustrated in FIG. 3, the heat sensing unit 170 includes a pinching plate 171 which is positioned under the guide 150 and comes in contact with balls 160 disposed therebelow, a ball balancer 173 which is positioned below the pinching plate 171 to block a lower end of the frame 120, a number of balls 160 positioned on a boundary of the ball balancer 173 while coming in contact with a hook 123 formed inside the frame 120, the pinching plate 171, and the ball balancer 173, a fixing bolt 175 which is positioned to penetrate the center of the pinching plate 171 and the ball balancer 173, a first heat plate 181 positioned under the ball balancer and at a lower end of the fixing bolt 175, and the fuse 177 interposed between the ball balancer 173 and the first heat plate 181. The ball 160 positioned between the pinching plate 171 and the ball balancer 173 is caught by the hook 123 and does not fall off.

In the heat sensing unit 170 as described above, the fuse 177 is fused by heat transmitted to the first heat plate 181 during fire. As the fuse 177 is fused, the ball balancer 173 positioned thereabove falls and is set on the first heat plate 181. As the balls 160 supported by the ball balancer 173 fall off, the heat sensing unit 170 is separated from the frame 120 to fall off.

The heat sensing unit as described above will now be described in detail.

The pinching plate 171 has a disc-shaped structure as illustrated in FIG. 5, and is provided with a hole at the center through which the fixing bolt 175 penetrates. In addition, the pinching plate 171 is provided with grooves 171*h* along its boundary to be concave, and the balls 160 are positioned inside the corresponding grooves 171*h*. The groove 171*h* is formed from the boundary toward the center of the pinching plate 171 in order to induce the balls 160 to move toward the center of the pinching plate 171 along the groove 171*h* and fall when the ball balancer 173 falls off the frame 120. As described above, in order to allow the balls 160 to be induced along the grooves 171*h* and fall, a gradient θ1 is formed on a top surface of the groove 171*h* so that the ball 160 rolls toward the inside of the pinching plate 171 along the gradient θ1 of the groove 171*h* and then falls.

The ball balancer 173 is positioned at a bottom surface of the pinching plate 171, and the balls 160 are positioned along a boundary of a space between the pinching plate 171 and the ball balancer 173.

A gradient θ2 is provided in an area that comes in contact with the ball balancer 173 or the ball 160. Therefore, when the ball balancer 173 is separated from the frame 120 to fall off, the ball 160 properly falls off along the gradient θ2. In a case where the balls 160 do not fall off along with the ball balancer 173 but are positioned at the normal position, the pinching plate 171 does not fall off from the frame 120, and the valve 130 may not be opened. Therefore, the gradients θ1 and θ2 are respectively formed on the groove 171*h* of the pinching plate 171 and the boundary of the ball balancer 173 that come in contact with the ball 160 to allow the ball 160 to properly fall off along with the ball balancer 173.

The ball balancer 173 is hung on the lower end of the hook 123 formed along the lower end inner peripheral surface of the frame 120. When the heat sensing unit 170 is assembled to the frame 120 while the frame 120 is separated from the body 110, the ball balancer 173 is positioned to interfere with the lower end of the hook 123 of the frame 120, the balls 160 are positioned inside the frame 120, the pinching plate 171 is put on the balls 160, the fixing bolt 175 is allowed to penetrate the hollows of the pinching plate 171 and the ball balancer 173, and the first heat plate 181 is fastened to the end portion of the fixing bolt 175. Then the balls 160 are hung on the hook 123 of the frame 120 so that the balls 160 and the ball balancer 173 are caught by upper and lower portions of the hook 123 so as to be fixed. Here, since the diameter of the pinching plate 171 is smaller than the inner diameter of the hook 123 formed at the lower end of the frame 120, when the ball balancer 173 falls, the pinching plate 171 also falls off the frame 120.

Configurations and assembling operations of the first heat plate 181 and the fuse 177 will now be described in detail.

As illustrated in FIGS. 3 and 5 to 8, a fuse piston 179 is screwed to a lower end of the fixing bolt 175 penetrating the pinching plate 171 and the ball balancer 173, the fuse 177 is positioned above the fuse piston 179, and the first heat plate 181 is positioned on the fuse 177. Therefore, when the fuse 177 is fused by the heat transmitted to the first heat plate 181, the first heat plate 181 falls off by a thickness of the fuse 177.

More specifically, a center of the first heat plate 181 has a structure of a cylinder 181*s* protruding upward, and a longitudinal center of the cylinder 181*s* is concave inwardly as illustrated in FIG. 8. The fuse 177 is positioned along an inner periphery of the cylinder 181*s* of the first heat plate 181 having the above-mentioned configuration, and the fuse piston 179 is fastened to the fixing bolt 175 from the inside of the cylinder 181*s*.

In addition, two second heat plates 182H and 182L are fitted to an outer periphery of the cylinder 181*s*. Among the two second heat plates 182H and 182L, the second heat plate 182L positioned below is provided with a hollow greater than an outer diameter of the cylinder 181*s* and is thus smoothly fitted to the cylinder 181*s*. But, the second heat plate 182H positioned above is forcibly inserted and fixed to an upper end of the cylinder 181*s*. As described above, the second plate 182H positioned above is forcibly inserted into the upper end of the cylinder 181*s* of the first heat plate 181, so that the second heat plates 182H and 182L are fixed to the first heat plate 181. Therefore, there are advantages in that it is convenient to assemble the heat sensing unit 170 to the frame 120, and the second heat plates 182H and 182L are not separated from each other even when the heat sensing unit 170 is separated from the frame 120.

An operation relationship of the fuse type sprinkler 100 having the above-mentioned configuration will be described. When fire occurs, the first and second heat plates 181 and 182 are heated, so that the fuse 177 is fused. Then, the ball balancer 173 put on the fuse 177 falls off, and as the ball balancer 173 falls, the balls 160 roll and fall off the frame 130 by the gradient θ1 formed on the groove 171*h* of the pinching plate 171 and the gradient θ2 of the ball balancer 173. As described above, when the balls 160 falls out of the frame 120, the pinching plate 171 and the guide 150 positioned on the balls 160 also fall off the frame 120, and the conical coil spring 137 extends. Here, the valve 130 is separated from the drain 117 of the body by an elastic force of the conical coil spring 137. More specifically, the valve 130 is moved downward by elastic force of the coil spring 137 and water pressure exerted on the drain. Here, only when the O-ring 131 is completely separated from the stepped portion 119 formed inside the drain 117, water is sprayed through the drain 117.

When the valve 130 falls off the drain 117, the deflector 140 falls off. The annular ring 141 of the deflector 140 is hung on the hook 123 of the frame 120 and does not fall off the frame 120, and the guide portion 143 of the deflector 140 is positioned below outside the frame 120.

Water sprayed from the drain 117 collides with the guide portion 143 positioned therebelow and is thus sprayed in the radial direction between the water spray pieces 145 bent upwardly from the boundary of the guide portion 143.

Embodiment 2

A fuse type sprinkler according to Embodiment 2 is different from the fuse type sprinkler according to Embodiment 1 in that, whereas the O-ring 131 is used as the sealing unit in Embodiment 1, a gasket which is another sealing unit is used instead of the O-ring in Embodiment 2. Other components of Embodiment 2 are similar to or the same as those of Embodiment 1. Therefore, detailed description of the components that have been described above in Embodiment 1 will be omitted.

Figure 9:
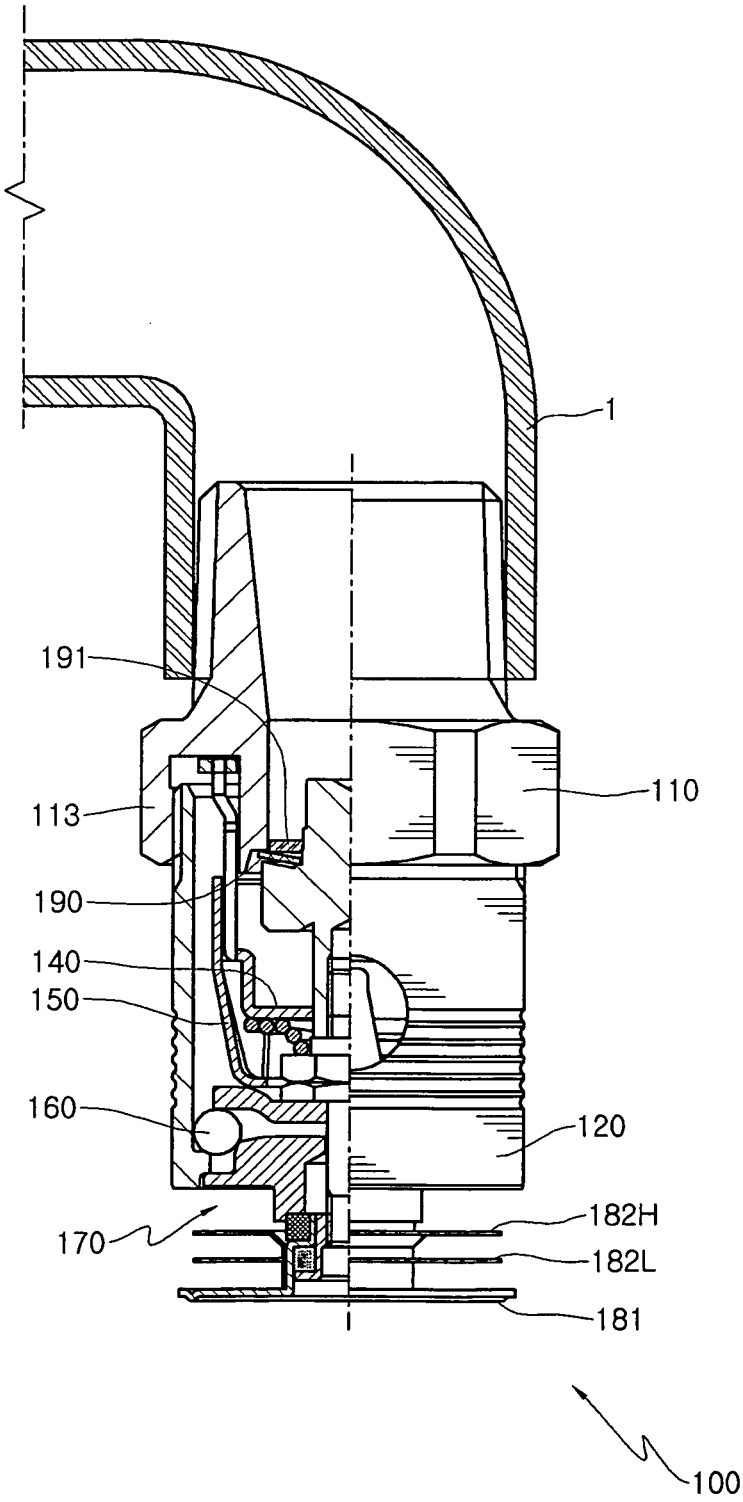
FIG. 9 is a partial sectional view illustrating a fuse type sprinkler according to another embodiment.
Figure 10:
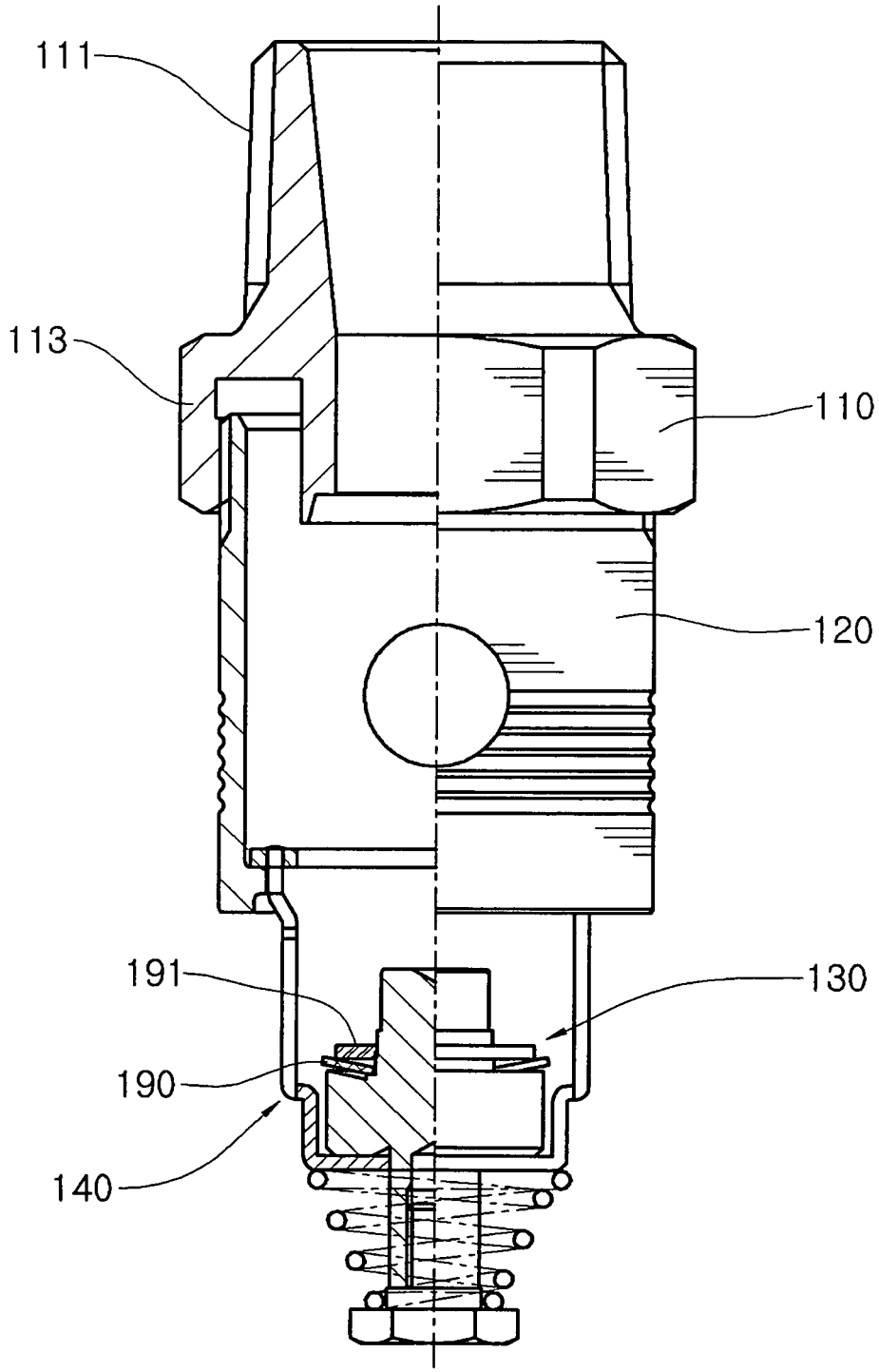
FIG. 10 is a partial sectional view illustrating a state where the fuse type sprinkler illustrated in FIG. 9 is operated.
Figure 11:
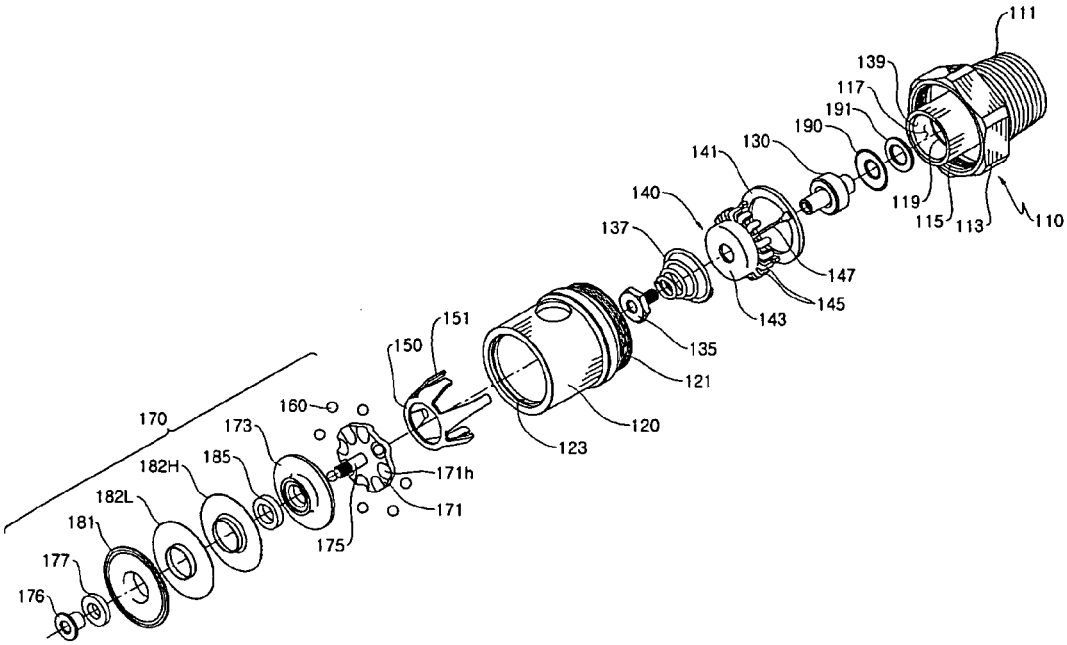
FIG. 11 is an exploded perspective view of the fuse type sprinkler illustrated in FIG. 9.
Figure 12:
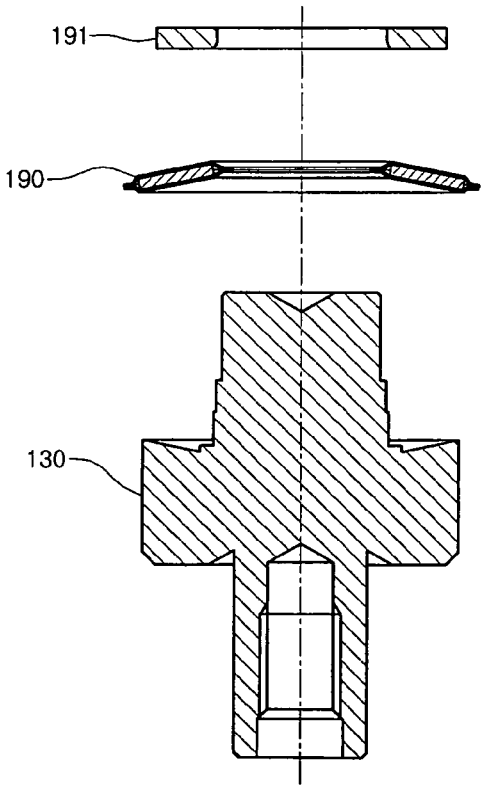
FIG. 12 is a sectional view illustrating an assemblage relationship between a valve, a gasket, and a washer illustrated in FIG. 9.

FIG. 9 is a partial sectional view illustrating the fuse type sprinkler according to Embodiment 2. FIG. 10 is a partial sectional view illustrating a state where the fuse type sprinkler illustrated in FIG. 9 is operated. FIG. 11 is an exploded perspective view of the fuse type sprinkler illustrated in FIG. 9. FIG. 12 is a sectional view illustrating an assemblage relationship between the valve, the gasket, and a washer illustrated in FIG. 9.

As illustrated in FIG. 9, the washer 191 is positioned at an upper end of the valve 130, and the gasket 190 is fixed and positioned to the valve 130 under the washer 191. In addition, the valve 130 is fitted into the drain 117 of the body 110, and the gasket 190 has a smaller diameter than an inner diameter of the stepped portion 119 formed at the lower end of the drain 117. However, since the gasket 190 has a convex top surface and a concave bottom surface, when the gasket 190 is pushed up from below, the gasket 190 comes in contact with the body 110, and as illustrated in FIG. 9, the top surface is elastically deformed to be concave and comes in close contact with the stepped portion 119 of the body 110. Here, as illustrated in FIG. 12, a flange top surface of the valve 130 which comes in contact with the gasket 190 is provided with a groove 130*h* which is recessed from the outside to the inside to induce elastic deformation of the gasket 190.

The force that pushes up the gasket 190 is the force that pushes up the valve 130 by the fixing bolt 175 as the frame 120 is screwed to the body 110, and thus the gasket 190 is elastically deformed to stably seal the lower end of the drain 117.

The gasket has the same function as the O-ring as described above, and since functions and operations of other components are the same as those of the components described above, detailed description thereof will be omitted.

Reference numeral 185 is an insulating member and is interposed between the first heat plate 181 and the ball balancer 173. This is because the fuse 177 may be fused by electrical current flowing along the drain. Therefore, the insulating member is used to block the current so as not to flow to the fuse 177.

Embodiment 3

A fuse type sprinkler according to Embodiment 3 is different from that according to Embodiment 2 in that a pocket ring 200 is used instead of the washer 191, and other components of Embodiment 3 are similar to or the same as those of Embodiment 2. Therefore, detailed description of the components that have been described according to Embodiment 2 will be omitted.

Figure 13:
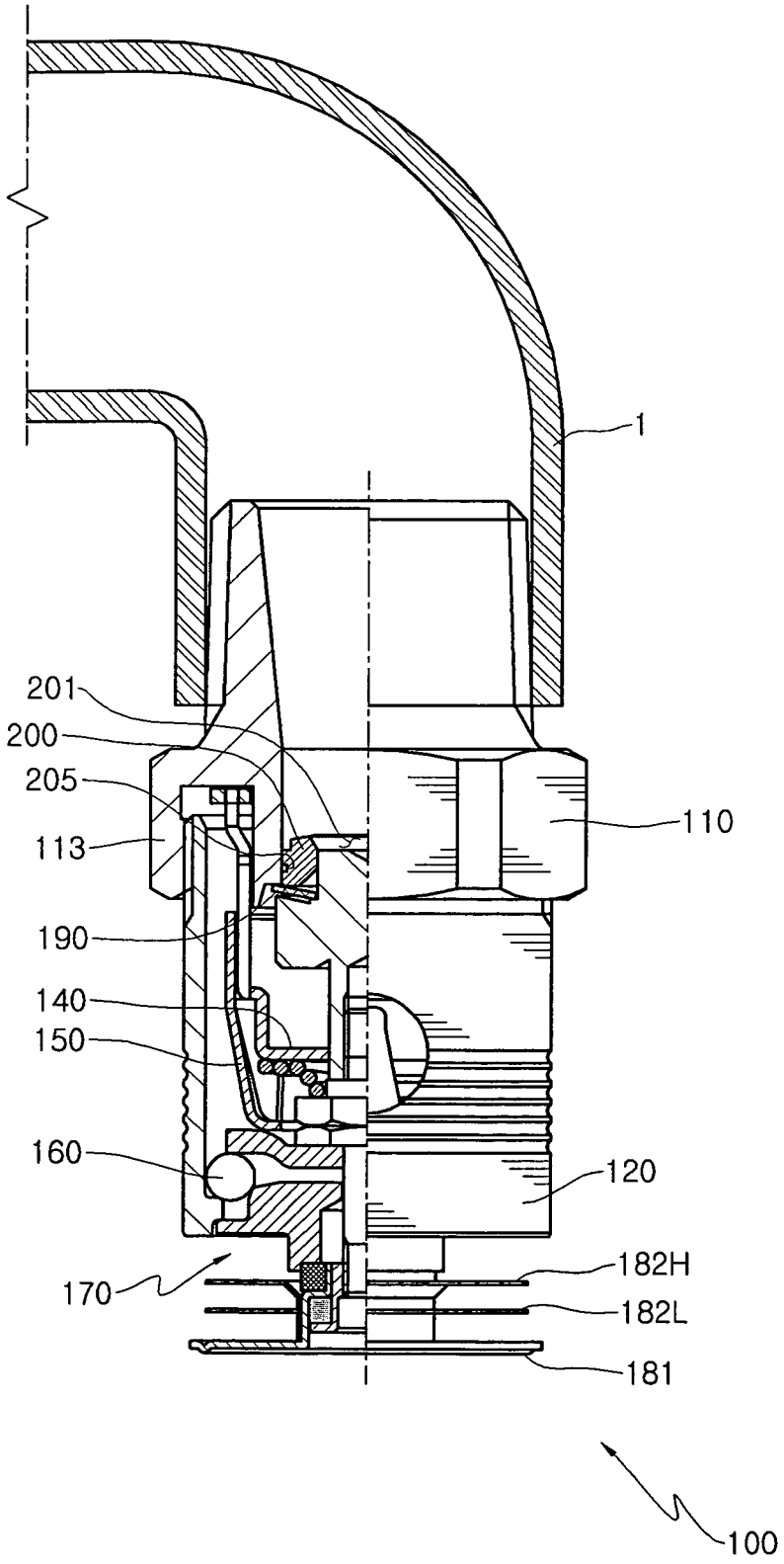
FIG. 13 is a partial sectional view illustrating a fuse type sprinkler according to still another embodiment.
Figure 14:
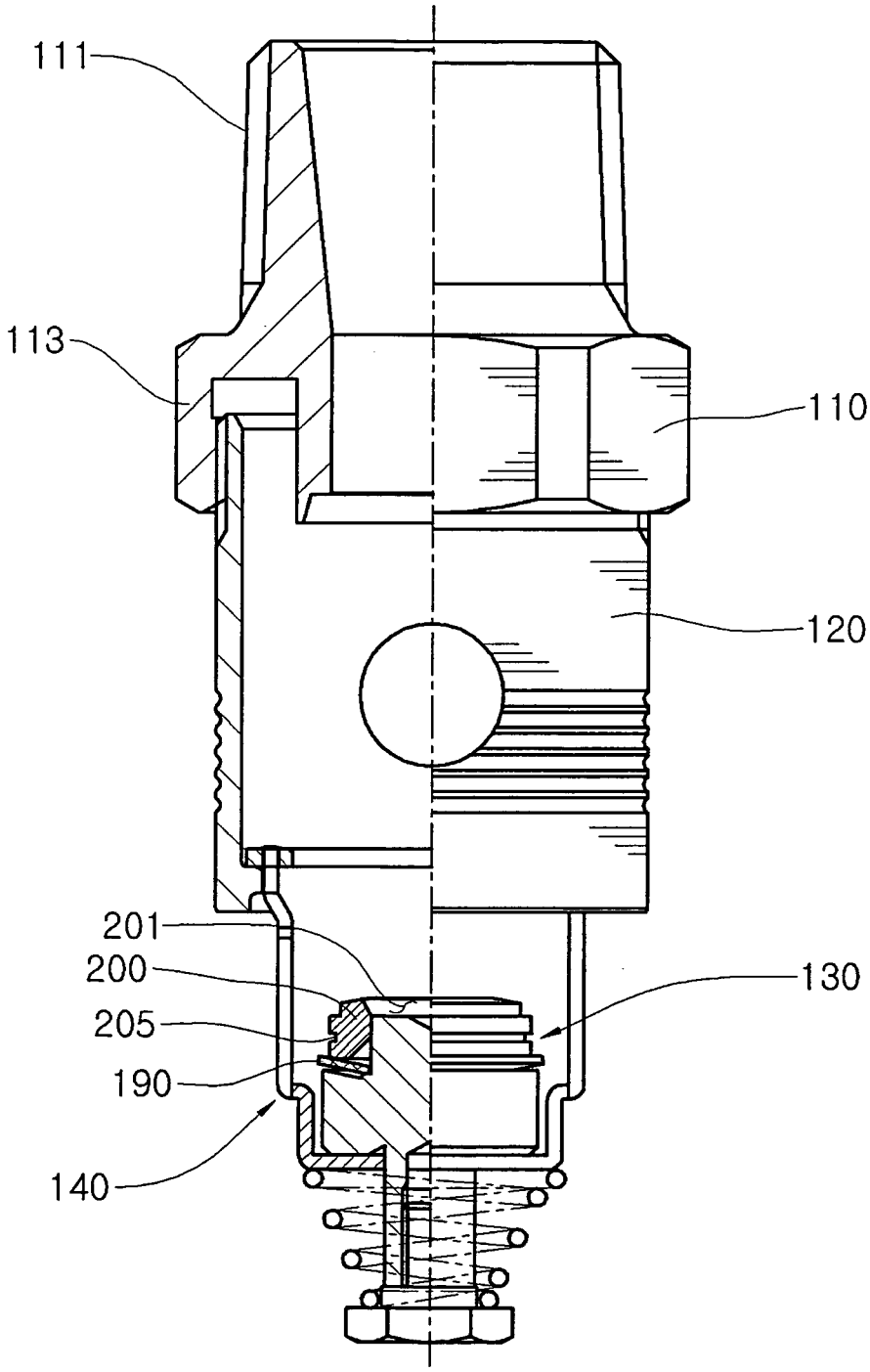
FIG. 14 is a partial sectional view illustrating a state where the fuse type sprinkler illustrated in FIG. 13 is operated.
Figure 15:
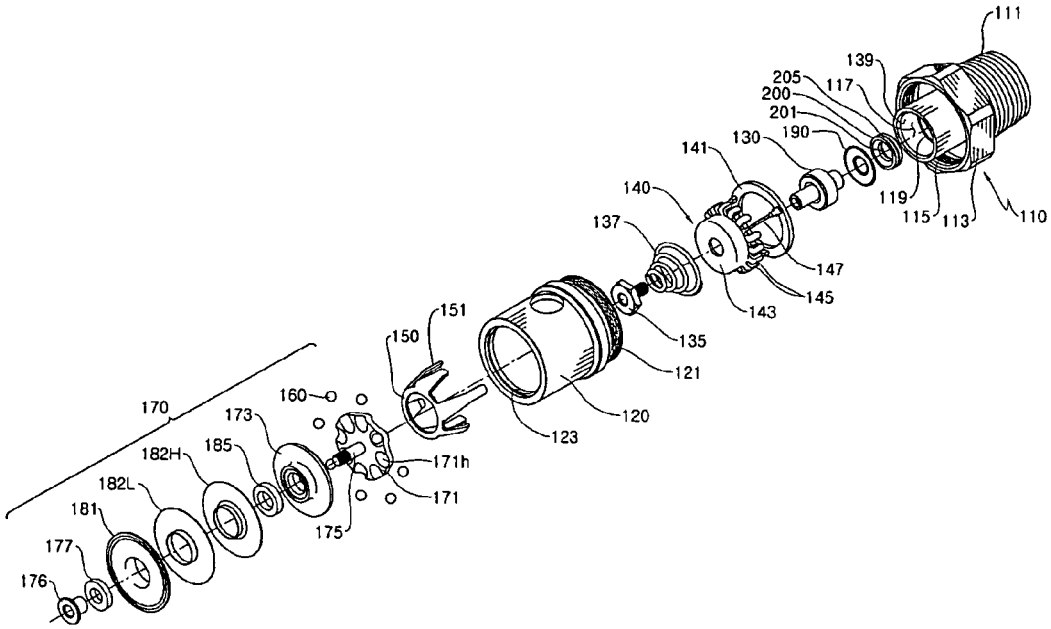
FIG. 15 is an exploded perspective view of the fuse type sprinkler illustrated in FIG. 13.
Figure 16:
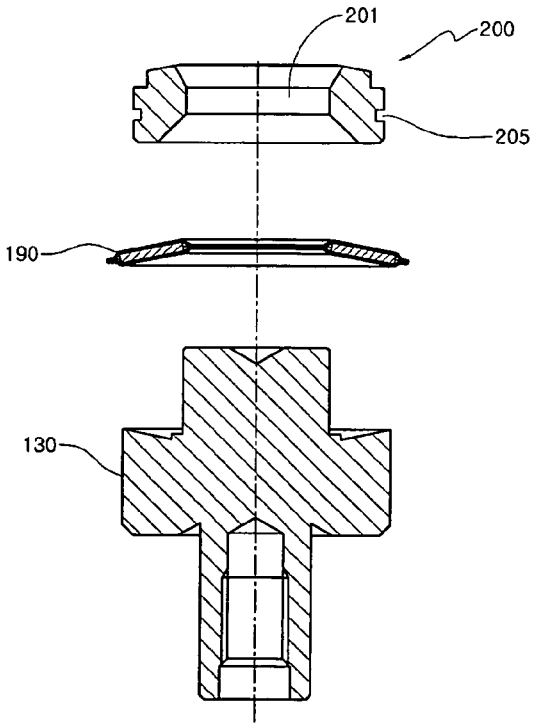
FIG. 16 is a sectional view illustrating an assemblage relationship between a valve, a gasket, and a washer illustrated in FIG. 13.

FIG. 13 is a partial sectional view illustrating the fuse type sprinkler according to Embodiment 3. FIG. 14 is a partial sectional view illustrating a state where the fuse type sprinkler illustrated in FIG. 13 is operated. FIG. 15 is an exploded perspective view of the fuse type sprinkler illustrated in FIG. 13. FIG. 16 is a sectional view illustrating an assemblage relationship between the valve, the gasket, and the washer illustrated in FIG. 13.

As illustrated in FIGS. 13 to 16, the pocket ring 200 is positioned at an upper end of the valve 130, and the gasket 190 is pushed by the valve 130 below the pocket ring 200 to be positioned in an elastically deformed state. The pocket ring 200 is provided with a hollow 201, the upper end of the valve 130 is positioned to penetrate through the hollow 201 of the pocket ring 200, and an outer peripheral surface of the pocket ring 200 is provided with an annular groove 205 along the circumference. The pocket ring 200 is inserted into the lower end of the drain, and a gap is formed between the outer peripheral surface of the pocket ring 200 and a lower inner peripheral surface of the stepped portion 119 of the drain 117.

The outer peripheral surface of the pocket ring 200 having the above-mentioned configuration is applied with a viscous lubricant, and the applied lubricant seals the gap between the lower inner peripheral surface of the drain and the pocket ring 200 to enhance sealing performance of the drain 117. The lubricant is used to enhance the sealing performance because sealing performance is low although processed surfaces of the drain 117 and the pocket ring 200 that are made of metal are in close contact with each other. Therefore, in order to compensate for the low sealing performance, the lubricant is applied to the processed surfaces, that is, between the lower inner peripheral surface of the drain and the pocket ring 200. In addition, the annular groove 205 formed on the outer peripheral surface of the pocket ring 200 is configured to allow the lubricant to flow into the annular groove 205 when the pocket ring 200 is inserted into the drain 117 and to allow the lubricant filling the annular groove 205 to be re-filled when the lubricant sealing the gap is insufficient.

In the fuse type sprinkler having the above-mentioned configuration according to Embodiment 3, the valve is moved downward by a degree of the fused fuse 177 in a state where a part of the fuse is fused during fire. Here, since the pocket ring 200 is positioned inside the drain 117, leaking does not occur between the pocket ring 200 and the inner peripheral surface of the drain 117. The pocket ring 200 is positioned on the inner peripheral surface of the drain 117 in a state where the fuse 177 is completely fused. If the fuse 177 is completely fused and the heat sensing unit 170 falls off, by elastic force of the conical coil spring 137 that is likely to extend and water pressure inside the drain, the valve 130 is moved downward, and accordingly the pocket ring 200 is moved downward along with the valve. As a result, the valve 130 falls off the drain 117, and thus the pocket ring 200 falls off the drain 117. As described above, as the valve 130 and the pocket ring 200 fall off the drain 117, water is sprayed through the drain 117.

While the exemplary embodiments have been shown and described, it will be understood by those skilled in the art that various changes in form and details may be made thereto without departing from the spirit and scope of this disclosure as defined by the appended claims.

In addition, many modifications can be made to adapt a particular situation or material to the teachings of this disclosure without departing from the essential scope thereof. Therefore, it is intended that this disclosure not be limited to the particular exemplary embodiments disclosed as the best mode contemplated for carrying out this disclosure, but that this disclosure will include all embodiments falling within the scope of the appended claims.

What is claimed is:

1. A fuse type sprinkler comprising:

a body which is fastened to a drain pipe for spraying water through a drain formed inside;

a valve of which an upper end is inserted into the drain of the body and to which a sealing unit is mounted along an upper end circumference to press and seal an inner surface of the drain;

a frame which is fastened to the body to surround the valve and is provided with a hook on a lower end inner peripheral surface;

a heat sensing unit which supports a lower end of the valve to allow the upper end of the valve to be inserted into the drain while being hooked by the hook of the frame, and is provided with a fuse which is separated from the frame to fall off when the fuse is fused by heat; and a deflector which is positioned inside the frame and falls off and is hung on the hook when the heat sensing unit is separated to distribute water sprayed through the drain, wherein the heat sensing unit includes:

a pinching plate;

a ball balancer positioned under the pinching plate;

a heat plate positioned under the ball balancer;

balls positioned at a boundary of a space between the pinching plate and the ball balancer to be positioned on an upper portion of the hook;

a fixing bolt penetrating centers of the pinching plate, the ball balancer, and the heat plate;

a fuse piston fastened to a lower end of the fixing bolt; and the fuse which is set on the fuse piston to support the heat plate.

2. The fuse type sprinkler according to claim 1, wherein a boundary of the pinching plate is provided with grooves formed toward the center to correspond to the balls, and the groove is provided with a gradient so that the balls roll toward the center of the pinching plate.

3. The fuse type sprinkler according to claim 2, wherein the ball comes in contact with the hook, the pinching plate, and the ball balancer, and a boundary of the ball balancer is provided with a gradient.

4. The fuse type sprinkler according to claim 1, wherein the ball comes in contact with the hook, the pinching plate, and the ball balancer, and a boundary of a ball balancer is provided with a gradient.

5. A fuse type sprinkler comprising:

a body which is fastened to a drain pipe for spraying water through a drain formed inside;

a valve of which an upper end is inserted into the drain of the body and to which a sealing unit is mounted along an upper end circumference to press and seal an inner surface of the drain;

a frame which is fastened to the body to surround the valve and is provided with a hook on a lower end inner peripheral surface;

a heat sensing unit which supports a lower end of the valve to allow the upper end of the valve to be inserted into the drain while being hooked by the hook of the frame, and is provided with a fuse which is separated from the frame to fall off when the fuse is fused by heat; and a deflector which is positioned inside the frame and falls off and is hung on the hook when the heat sensing unit is separated to distribute water sprayed through the drain, wherein a spring fixing bolt is fastened to the lower end of the valve, a coil spring is positioned between a head top surface of the spring fixing bolt and the deflector, and the coil spring is pressed as the upper end of the valve is pushed by the heat sensing unit and inserted into the drain when the frame mounted with the heat sensing unit is fastened to the body.

6. A fuse type sprinkler comprising:

a body which is fastened to a drain pipe for spraying water through a drain formed inside;

a valve of which an upper end is inserted into the drain of the body and to which a sealing unit is mounted along an upper end circumference to press and seal an inner surface of the drain;

a frame which is fastened to the body to surround the valve and is provided with a hook on a lower end inner peripheral surface;

a heat sensing unit which supports a lower end of the valve to allow the upper end of the valve to be inserted into the drain while being hooked by the hook of the frame, and is provided with a fuse which is separated from the frame to fall off when the fuse is fused by heat; and a deflector which is positioned inside the frame and falls off and is hung on the hook when the heat sensing unit is separated to distribute water sprayed through the drain, wherein a pocket ring which is the sealing unit is provided with a hollow through which the upper end of the valve penetrates, and an outer peripheral surface of the pocket ring is applied with a lubricant to seal between the outer peripheral surface of the pocket ring and an inner side surface of the drain.

7. The fuse type sprinkler according to claim 6, wherein an annular groove is formed along the outer peripheral surface of the pocket ring.

8. The fuse type sprinkler according to claim 7, wherein a gasket is mounted to the upper end of the valve below the pocket ring, and the gasket comes in contact with a stepped portion formed on a lower end inner side of the drain to seal the drain.

9. The fuse type sprinkler according to claim 6, wherein a gasket is mounted to the upper end of the valve below the pocket ring, and the gasket comes in contact with a stepped portion formed on a lower end inner side of the drain to seal the drain.

* * * * *